US007204223B2

(12) United States Patent
Kajiwara et al.

(10) Patent No.: US 7,204,223 B2
(45) Date of Patent: Apr. 17, 2007

(54) STRUCTURE OF CYLINDER BLOCK FOR ENGINE

(75) Inventors: Kunitoshi Kajiwara, Chiryu (JP); Yoshifumi Yamashita, Kyoutanabe (JP); Tomoya Bokkai, Otsu (JP); Tetsuro Miyashita, Kyoto (JP); Masayuki Kamo, Okazahi (JP); Shinichi Murata, Okazaki (JP)

(73) Assignees: Mitsubishi Jidosha Engineering Kabushiki Kaisha, Okazaki-shi, Aichi (JP); Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/091,534

(22) Filed: Mar. 29, 2005

(65) Prior Publication Data

US 2005/0217630 A1 Oct. 6, 2005

(30) Foreign Application Priority Data

Mar. 30, 2004 (JP) ..... 2004-097930

(51) Int. Cl.
*F02B 75/32* (2006.01)
*F02F 7/00* (2006.01)

(52) U.S. Cl. ..... 123/195 H

(58) Field of Classification Search ..... 123/195 R, 123/195 C, 195 H
See application file for complete search history.

(56) References Cited

U.S. PATENT DOCUMENTS 4,911,118 A * 3/1990 Kageyama et al. ..... 123/195 H
5,024,189 A 6/1991 Ushio et al.

FOREIGN PATENT DOCUMENTS

DE 3542136 C2 6/1986
DE 4207991 C2 9/1993
DE 10231681 A1 2/2003
JP 6-27770 Y2 7/1994

* cited by examiner

*Primary Examiner*—Stephen K. Cronin
*Assistant Examiner*—Hyder Ali
(74) *Attorney, Agent, or Firm*—Birch, Stewart, Kolasch & Birch, LLP

(57) ABSTRACT

A structure of a cylinder block includes the cylinder block having a number of cylinders; a plurality of bearing caps supporting a crankshaft along with the cylinder block; a bearing cap beam supporting each of the plural bearing caps; a number of cap bolts fastening the plural bearing caps and the bearing cap beam to the cylinder block; and beam bolts fixing the bearing cap beam to a skirt portion of the cylinder block; a plurality of baffles each of which protruding from the bearing cap beam along a rotation path of a part of the crankshaft; and a number of vertical walls engaging the plural bearing cap beam with the baffles in a vertical direction.

10 Claims, 6 Drawing Sheets

STRUCTURE OF CYLINDER BLOCK FOR ENGINE

CROSS-REFERENCE TO RELATED APPLICATION

This application incorporates by references the subject matter of Application No. 2004-97930 filed in Japan on Mar. 30, 2004, on which a priority claim is based under § U.S.C. 119(a).

BACKGROUND OF THE INVENTION

1. Field of the Invention

The present invention relates to a structure of a cylinder block.

2. Description of the Related Art

Generally, a skirt portion, the lower structure of a cylinder block for an engine (an internal combustion engine), forms a crankcase to contain a crankshaft.

For example, an accompanying drawing FIG. 8 schematically illustrates a cylinder block for an engine (a V-engine) seen from the axis direction of a crankshaft. As shown in FIG. 8, a crankshaft 3 is arranged inside a skirt portion 2 of the cylinder block 1. The crankshaft 3 is mounted, via bearings (bearing metals, not shown), on bearing mechanisms 4 formed in the cylinder block 1 and bearing caps 5 are attached to bottom of the bearing mechanisms 4 in order to fix the bearings of the crankshaft 3. The bearing mechanisms 4 are placed at both ends and appropriate intermediate portions of the engine. A bearing cap 5 is mounted on each of the bearing mechanisms 4.

In order to fasten the bearing caps 5 to the cylinder block 1, beams 6 in the separated form from the bearing caps 5 are to attached to each bearing cap 5. Each beam 6 is disposed at the skirt portion 2 of the cylinder block 1 in such a direction that the beam 6 extends in the crosswise direction (perpendicular to the crankshaft 3) of the engine. The both end of each beam 6 is fixed to the skirt portion by bolts 7 and the intermediate portion between the both ends is fixed, together with the corresponding bearing cap 5, to the bearing mechanism 4 by longer bolts 8.

An oil pan (however not shown) is arranged under the skirt portion 2 (under the beams 6) of the cylinder block 1 and store a drain of an engine oil serving as a lubricant in the cylinder block 1. Further, a baffle plate is placed between the top of the oil pan and the bottom of the beams 6.

In relation to such a technique for a skirt portion of a cylinder block, for example, Japanese Utility Model Publication No. HEI 6-27770 discloses a baffle plate, attached to the bottom of a cylinder block, forms along the rotation path of a crank axis and includes a reinforcement rib.

SUMMARY OF THE INVENTION

One aspect of the present invention is directed to a structure of a cylinder block enhanced in stiffness that can reduce a friction caused by rotation of a crankshaft.

The present invention provides a structure of a cylinder block in an engine comprising: the cylinder block having a number of cylinders; a plurality of bearing caps supporting a crankshaft along with the cylinder block; a plurality of bearing cap beams, disposed one beneath each of the plural bearing caps, supporting the plural bearing caps; a number of cap bolts fastening the plural bearing caps and the bearing cap beam to the cylinder block; and a number of beam bolts fixing the bearing cap beam to a skirt portion of the cylinder block; a plurality of baffles, disposed one between each adjacent pair of the bearing cap beam and supporting the plural bearing caps via the bearing cap beam, each of which protruding from the bearing cap beam along a rotation path of a part of the crankshaft, and a number of vertical walls engaging the bearing cap beam with the a plurality of baffles in a vertical direction.

Other objects and further features of the present invention will be apparent from the following detailed description when read in conjunction with the accompanying drawings.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE INVENTION

A preferred embodiment of the present invention will now be described with reference to the accompanying drawings FIGS. 1–7, which illustrate the configuration of a cylinder block according to the first embodiment of the present invention.

Figure 1:
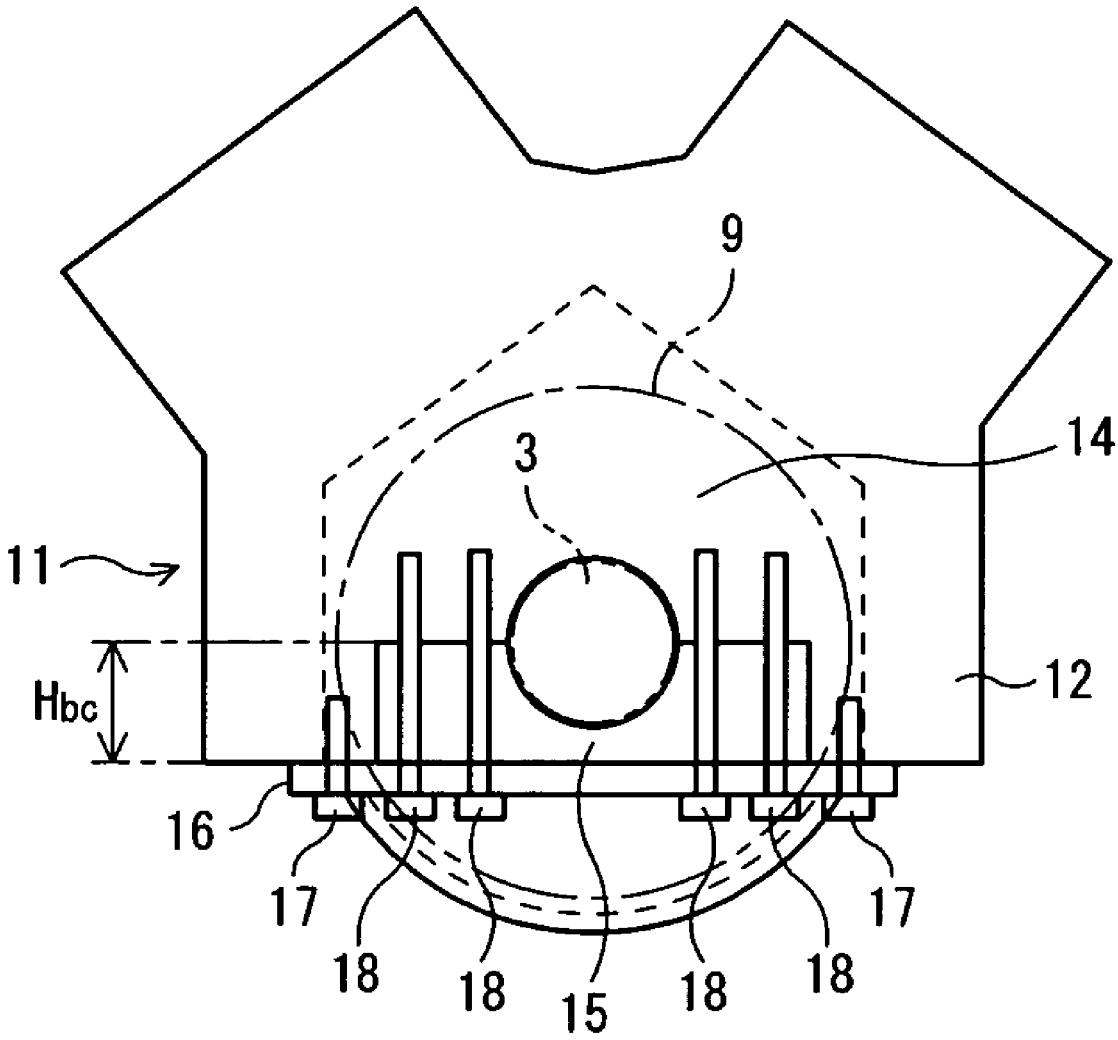
FIG. 1 is a schematic diagram illustrating a cylinder block in an engine seen from axis direction of a crankshaft according to a first embodiment of the present invention.

FIG. 1 schematically illustrates a cylinder block of the first embodiment in an engine seen from the axis direction of a crankshaft. As shown in FIG. 1, a bearing mechanism 14 is provided inside a skirt portion 12 of a cylinder block 11. The bearing mechanism 14 has a crankshaft hole 11*a* (see FIG. 2) through which a crankshaft 3 is mounted via a bearing (not shown). Beneath the bearing mechanism 14, a bearing cap 15 is placed in order to fix a bearing of the crankshaft 3.

A bearing mechanism 14 is disposed at each of the both ends of the engine (the both end in the axis direction of the crankshaft 3) and one or more bearing mechanisms 14 are appropriately placed at intermediate portions of the engine (inside the crankshaft 3). To each of the bearing mechanisms 14 thus placed, a single bearing cap 15 is attached. In order to fix the bearing caps 15 to the cylinder block 11, a beam panel 16 in a separated form from the bearing caps 15 and having bearing cap beams 16*a* is attached to the cylinder block 11.

In the first embodiment as shown in FIG. 1, the beam panel 16 is arranged so as to overlap rotation paths 9 of eccentric members exemplified by cranks and counterweights of the crankshaft 3 in the cylinder block 11 when seen from the axis direction of the cylinder block 11. Since each of the bearing mechanisms 14 and the bearing cap beam 16*a* of the beam panel 16 associated with the bearing mechanism 14 are located at a portion deviated from positions at which the eccentric members of the crankshaft 3 that rotate along the rotation paths 9 are arranged, each bearing cap beam 16*a* of the beam panel 16 does not interfere with rotation of the crankshaft 3.

Figure 2:
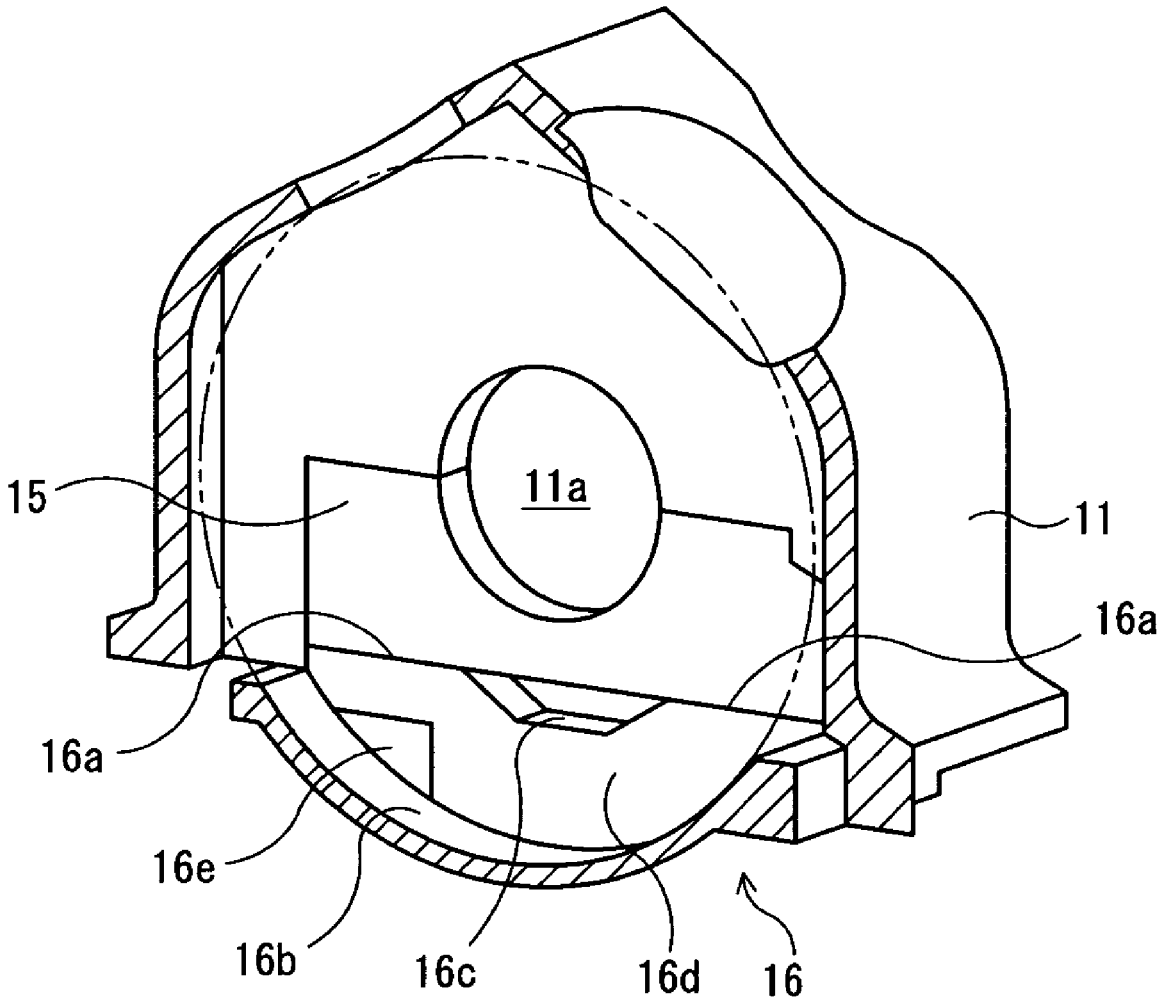
FIG. 2 is a schematic perspective view illustrating the main part of the cylinder block shown in FIG. 1.
Figure 4:
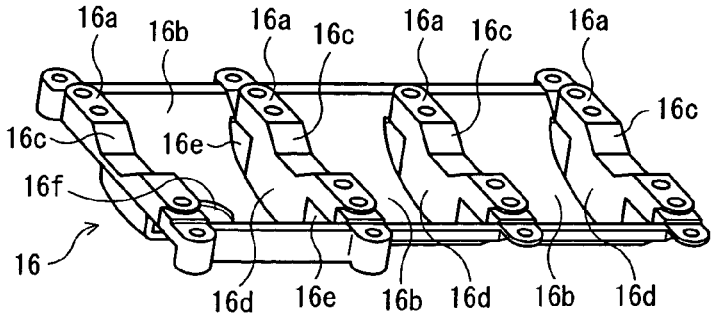
FIG. 4 is a top perspective view illustrating a beam panel included in the cylinder block of FIG. 1.
Figure 5A:
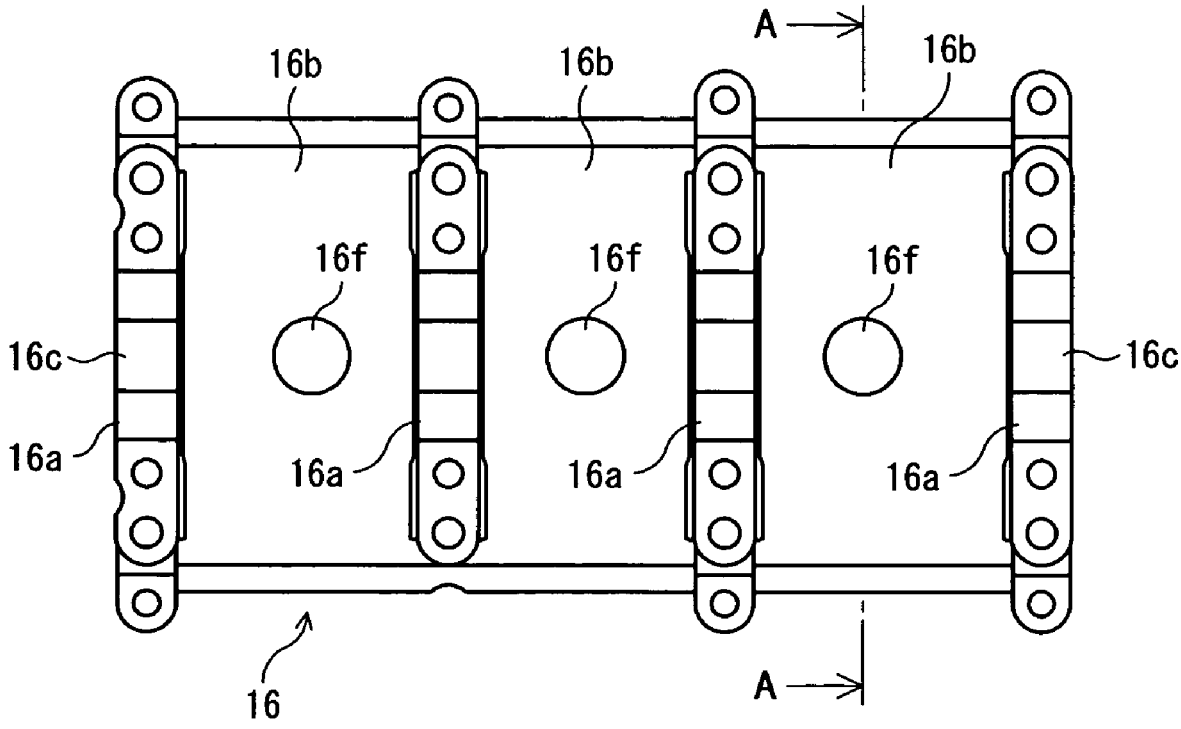
FIGS. 5(*a*) and 5(*b*) are diagrams illustrating the beam panel of the cylinder block of FIG. 1, and particularly FIG. 5(*a*) is a top plain view thereof and FIG. 5(*b*) is a sectional view thereof sectioned by the line A—A of FIG. 5(*a*)
Figure 5B:
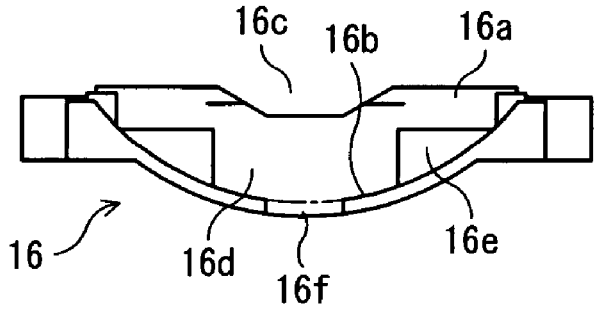
Figure 6:
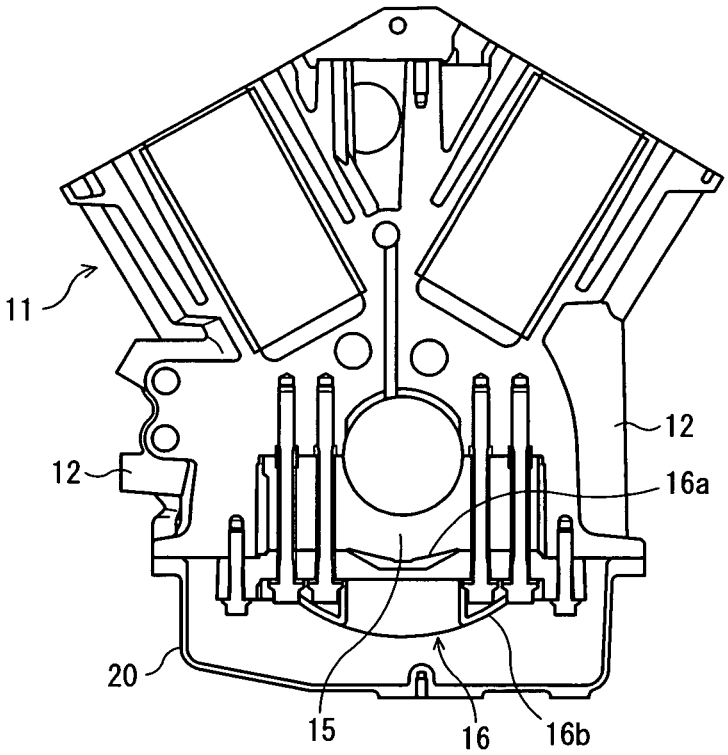
FIG. 6 is a horizontal sectional view detailed illustrating the cylinder block shown in FIG. 1.
Figure 7:
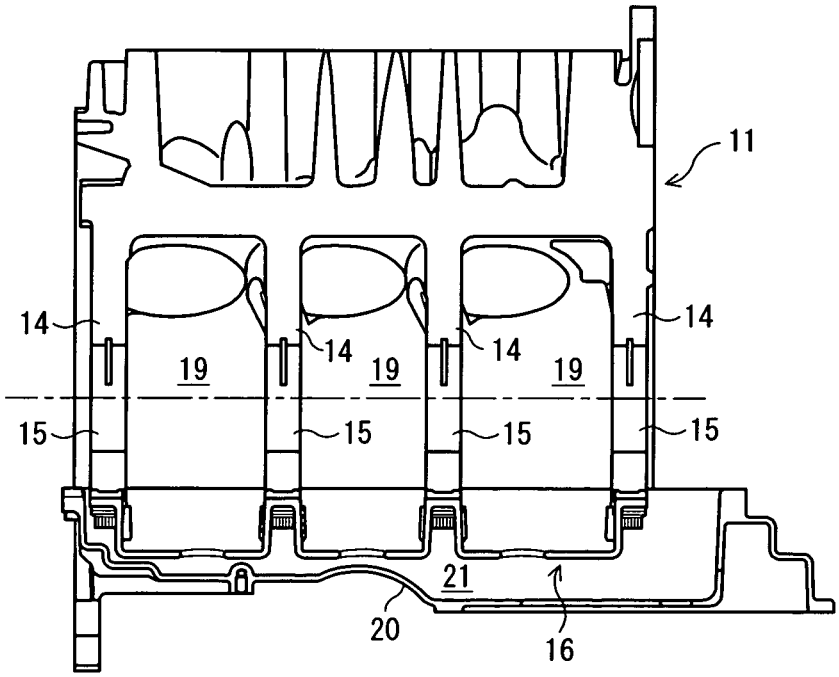
FIG. 7 is a longitudinal sectional view illustrating the cylinder block shown in FIG. 1.
Figure 8:
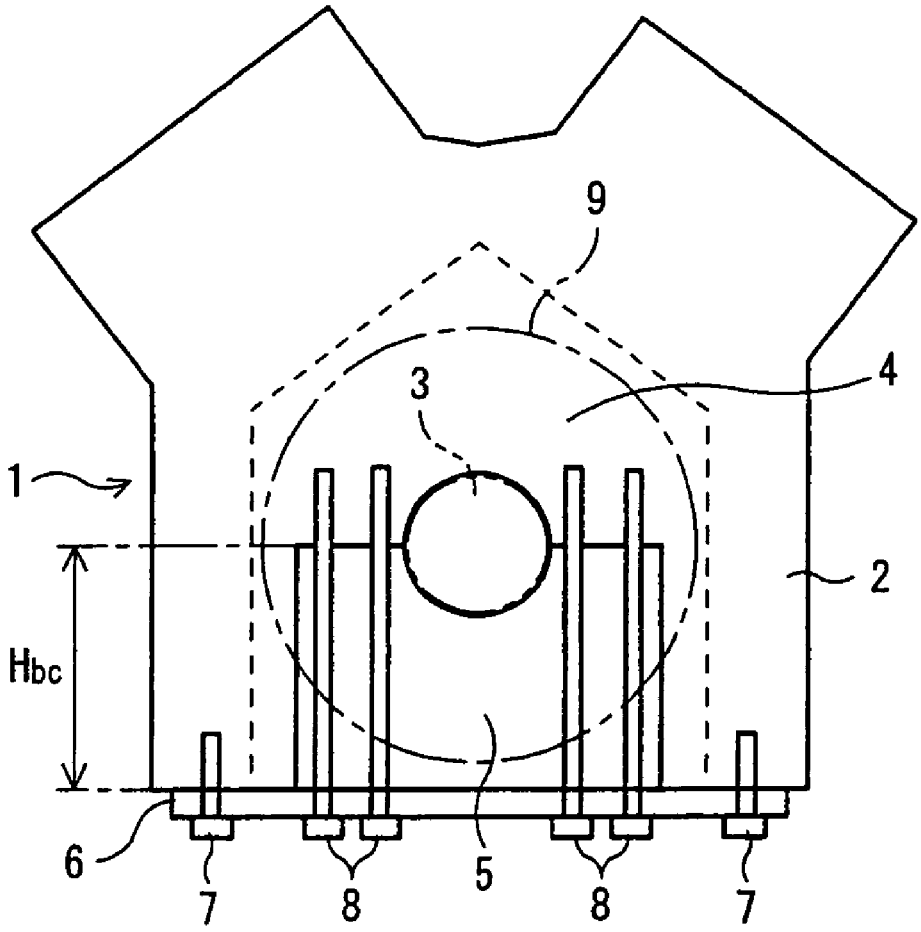
FIG. 8 PRIOR ART
FIG. 8 is a schematic diagram illustrating a conventional cylinder block of an engine seen from the axis direction of the crankshaft.

In other words, the beam panel 16 includes a number (here, four) of bearing cap beams 16*a*, corresponding one to each of the bearing mechanisms 14 arranged at the both end of the cylinder block 11 (the both ends of the crankshaft 3) and at the intermediate portion the crankshaft 3, and a number of baffles (corresponding to baffle plates) 16*b*, serving as connections between the bearing cap beams 16*a*, downwardly protruding from the bearing cap beams 16*a*, as shown in FIGS. 2, 4, 5(*a*) and 5(*b*) that are a schematic perspective view of the main part of the cylinder block 11, a top perspective view of the beam panel 16, and plain and sectional views of the beam panel 16, respectively.

Each of the baffles 16*b* functions as a baffle plate used to avoid fluctuation in level of an engine oil surface in oil pan 20 (see FIGS. 6 and 7) placed under the cylinder block 11 which fluctuation is resulted from rotation of the crankshaft 3. Each baffle 16*b* has a section in the form of a substantial arc and is placed so as to have a regular clearance along the rotation paths 9.

The clearance between each baffle 16*b* and the rotation path 9 is preferably set such that the baffle 16*b* adjusts a flow of air including mists of an engine oil which flow is generated as a consequence of rotation of the crankshaft 3 and smoothes the flow. An excessive large clearance makes it difficult to adjust the air flow generated by the crankshaft 3 and to thereby smooth the air flow; and conversely, an excessive small clearance causes a friction for rotation of the crankshaft 3. For this reason, the largeness of a preferable clearance is appropriately determined considering the above points.

Figure 3:
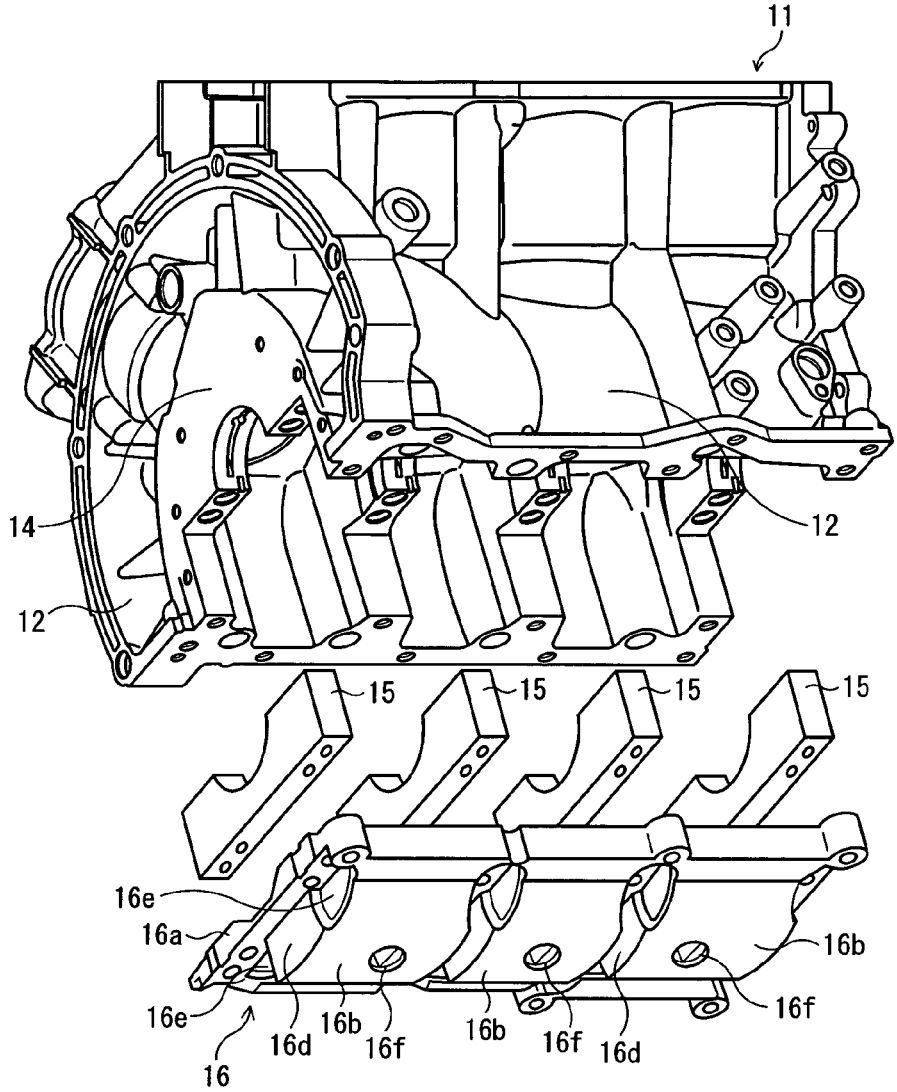
FIG. 3 is an exploded perspective view illustrating the cylinder block of FIG. 1.

Each bearing cap 15 is disposed in such a posture that the top surface thereof is in contact with the bottom surface of the corresponding bearing mechanism 14 of the cylinder block 11 and the bottom surface thereof is in contact with the top surface of the corresponding bearing cap beam 16*a*, as shown in FIGS. 1, 3 (an exploded perspective view of the cylinder block 11), 6 (a horizontal sectional view of the cylinder block 11) and 7 (a longitudinal sectional view of the cylinder block 11). The beam panel 16 is arranged close to the axis of the crankshaft 3 as described above, so that the bearing caps 15 have height Hbc smaller by an extent of the closeness.

Each of the beam portions 16*a* has a recess 16*c* on the top surface thereof and the recess 16*c* serves as a vent communicating adjacent crankcase portions (spaces 19) for the cylinders when the corresponding bearing cap 15 is attached. In addition, one or more vents 16*e* are formed on a vertical wall 16*d* engaging the top surface of each of bearing cap beam 16*a* with the corresponding baffle 16*b*. Further, each baffle 16*b* has a vent 16*f*. The recesses 16*c*, serving as vents, and the vents 16*e* communicates adjacent spaces 19 enclosed by the bearing mechanisms 14, the bearing cap 15 and the other parts in the crankcase and communicates a space 19 with a portion of an oil reservoir 21 in the oil pan 20 which portion is outside the ends of the cylinder block 11. The vents 16*f* communicates each of the spaces 19 with the remaining portion of oil reservoir 21 in the oil pan 20 which portion is disposed under the cylinder block 11.

The beam panel 16 having the above-described configuration is fixed to the cylinder block 11 by beam bolts 17 fastening the both ends of each bearing cap beam 16*a* (in the crosswise direction of the engine) to the cylinder block 11. At the same time, each bearing cap 15 is fastened and fixed together with the beam panel 16 to the corresponding bearing mechanism 14 in the cylinder block 11 by cap bolts 18. Especially, two or more (here, two) of the cap bolts 18 are arranged on either side of each bearing cap 15 in a straight line in a direction that each beam 16*a* is extending which direction is perpendicular to the axis of the crankshaft 3.

Use of two or more cap bolts 18 for fastening of each bearing cap 15 at either side thereof ensures enough stiffness to tolerate large load on the bearing cap 15 caused by rotation of the crankshaft 3 while the engine is running.

The cross-directional width of the cylinder block 11, the external diameter of a portion of the crankshaft 3 which portion is to be supported by the bearing mechanisms 14 and the diameter of the bolts to be used determine the number of bolts that are able to be arranged (on each of the both sides perpendicular to the axis of the crankshaft 3) in the cross direction of the engine in order to attach the beam panel 16 to the cylinder block 11. In the illustrated example, three bolts can be used on each of right and left sides that are interposed by the axis of the crankshaft 3.

Three bolts are used on each side in the crosswise direction of the beam panel 16; two of three bolts fix a bearing cap 15 and the corresponding bearing cap beam 16*a* to the cylinder block 11. But the number of bolts should by no means be limited and alternatively, four bolts may be used to fastening on each of the both sides of a bearing cap beam 16*a* if possible. If four bolts are used on each side, two or three of the four bolts can be used for fixing each bearing cap 15 and the bearing cap beam 16*a* to the cylinder block 11. Above all, since a larger number of bolts are preferably used for engagement a bearing cap 15 and the bearing cap beam 16a to the cylinder block 11 as described above, more preferable manner is use of three of the four are used for engagement a bearing cap 15 and the corresponding bearing cap beam 16*a* to the cylinder block 11. Conversely, if each side can afford space for only two bolts, a single bolt can be used for fixing engagement a bearing cap 15 and the beam panel 16 to the cylinder block 11, of course.

On each of the both sides of each bearing cap beam 16*a*, a beam bolt 17 and cap bolts 18, 18 are arranged in line with the beam bolt 17 disposed at the outermost end, such that these bolts position as close as possible. Of course, the heads of the beam bolt 17 and the cap bolts 18, 18 come to close to each other so as not to interfere with fastening the bearing cap 15 and the bearing cap beam 16*a* to the cylinder bock 11. These bolts 17, 18, 18 are arranged at substantially equal intervals so that it is possible to efficiently improve the stiffness of the cylinder block 11.

The structure of the cylinder block of an engine according to the first embodiment has a configuration as described above. Since a beam bolts 17 fixing a beam panel 16 to a skirt portion 12 of the cylinder block 11 are arranged in the proximity of a cap bolt 18 fastening a bearing cap 15 and the bearing cap beam 16*a* to the cylinder block 11, the rigidity of the cylinder block 11 improves and concurrently inclination of a bearing cap 15 in the axis direction of the crank can be inhibited with ease.

Adjacent two of the bolts 17, 18, 18 are arranged in the substantial identical intervals. In other words, the distance between the beam bolt 17 and one cap bolt 18 placed the nearest to the beam bolt 17 is substantially identical to that between adjacent two of a number of cap bolts 18 disposed on the same side of each bearing cap beam 16*a*. It is thereby possible to further enhance the stiffness of the cylinder block 11. Connection of the bearing cap beams 16*a* by the baffle plates (baffles) 16*b* further strengthens the rigidity of the beam panel 16 and the rigidity of each bearing cap beam 16*a*, consequently the stiffness of the cylinder block 11 is enhanced. Especially, each baffle 16*b* takes the form of plate having an arc section and protrudes the bottom of the bearing cap beams 16*a*, so that the stiffness of the beam panel 16 and the rigidity of each bearing cap beam 16*a* can be efficiently enhanced.

In particular, each bearing cap beam 16*a* is arranged nearer to the axis of the crankshaft 3 than the distance between the axis and the bottom of the rotation path 9 of the crankshaft 3 and upwardly fastens the bottom of the corresponding bearing cap 15 to the cylinder block 11, so that it is possible to shorten the height Hbc of each bearing cap 15. That promotes reduction in size and in weight of the cylinder block 11 and also advantageously promotes improvement in stiffness of the cylinder block 11.

Each baffle 16*b* curves along the rotation path 9 of the crankshaft 3, air containing engine oil mist can smoothly rotate in company with the rotation of the crankshaft 3, so that it is possible to reduce rotation friction for the crankshaft 3.

A vent (first vent) 16*e*, which is formed on each vertical wall 16*d* engaging a bearing cap beam 16*a* and a corresponding baffle 16*b*, communicates with the oil reservoir 21 of the oil pan 20, so that air and oil mist rotation along with the crankshaft 3 pass out to the oil reservoir 21 whereby it is also possible to reduce rotation friction for the crankshaft 3. Similarly, a vent 16*f*, which is formed on each baffle 16*b*, communicates with the oil reservoir 21 of the oil pan 20, so that air and oil mist rotation along with the crankshaft 3 pass out to the oil reservoir 21 whereby it is also possible to reduce rotation friction for the crankshaft 3.

With the presence of the baffles 16*b*, each crankcase portion is a closed space enclosed by the baffles 16*b* and air moves in company with operation by pistons cannot escape out of the crankcase portion, so that the air in the closed space can be a friction for rotation of the crankshaft 3. Since the first embodiment has a vent 16*c* (second vent) between each bearing cap 15 and the corresponding bearing cap beam 16*a* and the vent 16*c* communicates adjacent cylinders, air moves in company with operation by pistons can pass out whereby the friction is reduced.

Further, the present invention should by no means be limited to the foregoing embodiment, and various changes or modifications may be suggested without departing from the gist of the invention.

In the first embodiment, description is made in relation to a cylinder block for a V-engine. Alternatively, the present invention can be applied to cylinder blocks of an inline engine and a box engine, of course.

What is claimed is:

1. A structure of a cylinder block in an engine, comprising:

the cylinder block having a number of cylinders;

a plurality of bearing caps supporting a crankshaft along with said cylinder block;

a plurality of bearing cap beams, disposed beneath said cylinder block, each of the plurality of bearing cap beams supporting respective one of said plurality of bearing caps;

a number of cap bolts penetrating into the cylinder block for fastening said plurality of bearing caps and said plurality of bearing cap beams to said cylinder block;

a number of beam bolts fixing said plurality of bearing cap beams to a skirt portion of said cylinder block;

a plurality of baffles, each baffle disposed between each adjacent pair of said plurality of bearing cap beams and supporting said plurality of bearing caps via said plurality of bearing cap beams, each of the plurality of baffles protruding from said bearing cap beams and curves so as to have a regular clearance along a rotation path of the crankshaft; and a number of vertical walls engaging said bearing cap beams with said baffles in a vertical direction.

2. A structure of a cylinder block in an engine according to claim 1, further comprising:

a plurality of second vents, each vent disposed between each a bearing cap and a corresponding bearing cap beam, communicating adjacent cylinders.

3. A structure of a cylinder block in an engine according to claim 2, wherein said cap bolts associated with each of said plurality of bearing caps and said beam bolts associated with one of said bearing cap beams that is disposed beneath each bearing cap are arranged in a substantial straight line in a direction that one beam is extending which direction is perpendicular to the crankshaft.

4. A structure of a cylinder block in an engine according to claim 1, wherein said cap bolts associated with each of said plurality of bearing caps and said beam bolts associated with one of said bearing cap that is disposed beneath each bearing cap are arranged in a substantial straight line in a direction that one beam is extending which direction is perpendicular to the crankshaft.

5. A structure of a cylinder block in an engine according to claim 1, wherein each of the plurality of baffles has an arc shape.

6. A structure of a cylinder block in an engine, comprising:

the cylinder block having a number of cylinders;

a plurality of bearing caps supporting a crankshaft along with said cylinder block;

a plurality of bearing cap beams, disposed beneath said cylinder block, each of the plurality of bearing cap beams supporting a respective one of said plurality of bearing caps;

a number of cap bolts fastening said plurality of bearing caps and said plurality of bearing cap beams the bearing cap beam to said cylinder block;

a number of beam bolts fixing said plurality of bearing cap beams skirt portion of said cylinder block;

a plurality of baffles, each baffle disposed between each adjacent pair of said plurality of bearing cap beams and supporting said plurality of bearing caps via said plurality of bearing cap beams, each of the plurality of baffles protruding from said bearing cap beams along a rotation path of the crankshaft; and a number of vertical walls engaging said bearing cap beam with said baffles in a vertical direction, wherein each of said vertical walls has first vents communicating with an oil reservoir of an oil pan.

7. The structure of a cylinder block in an engine according to claim 6, further comprising:

a plurality of second vents, each vent disposed between each a bearing cap and a corresponding bearing cap beam, communicating adjacent cylinders.

8. A structure of a cylinder block in an engine according to claim 7, wherein said cap bolts associated with each of said plurality of bearing caps and said beam bolts associated with one of said bearing cap beams that is disposed beneath each bearing cap are arranged in a substantial straight line in a direction that one beam is extending which direction is perpendicular to the crankshaft.

9. A structure of a cylinder block in an engine according to claim 6, wherein said cap bolts associated with each of said plurality of bearing caps and said beam bolts associated with one of said bearing cap beams that is disposed beneath each bearing cap are arranged in a substantial straight line in a direction that one beam is extending which direction is perpendicular to the crankshaft.

10. The structure of a cylinder block in an engine according to claim 6, wherein each of the plurality of baffles has an arc shape.

* * * * *